US008707918B2

(12) United States Patent
Richter et al.

(10) Patent No.: US 8,707,918 B2
(45) Date of Patent: Apr. 29, 2014

(54) VALVE TRAIN OF A COMBUSTION PISTON ENGINE

(75) Inventors: Frank Richter, Oberteuringen (DE); Reiner Keller, Bodman-Ludwigshafen (DE); Markus Wannags, Eriskirch (DE); Ilja Imgrunt, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 13/816,387

(22) PCT Filed: Jul. 7, 2011

(86) PCT No.: PCT/EP2011/061473
§ 371 (c)(1),
(2), (4) Date: Feb. 11, 2013

(87) PCT Pub. No.: WO2012/025287
PCT Pub. Date: Mar. 1, 2012

(65) Prior Publication Data

US 2013/0146007 A1 Jun. 13, 2013

(30) Foreign Application Priority Data

Aug. 27, 2010 (DE) ..... 10 2010 039 861

(51) Int. Cl.
*F01L 1/34* (2006.01)
*F01L 1/344* (2006.01)

(52) U.S. Cl.
CPC ..... *F01L 1/344* (2013.01)
USPC ..... 123/90.17

(58) Field of Classification Search
CPC ..... F01L 1/344; F01L 1/34; F01L 2001/3522
See application file for complete search history.

(56) References Cited

U.S. PATENT DOCUMENTS 7,032,552 B2 4/2006 Schafer et al.
7,841,312 B2 11/2010 Richter (Continued)

FOREIGN PATENT DOCUMENTS

DE 10 2006 011 806 A1 10/2007
DE 10 2006 028 554 A1 1/2008

(Continued)

OTHER PUBLICATIONS

German Search Report Corresponding to DE 10 2010 039 861.6.

(Continued)

*Primary Examiner* — Thomas Denion
*Assistant Examiner* — Daniel Bernstein
(74) *Attorney, Agent, or Firm* — Davis & Bujold, PLLC; Michael J. Bujold

(57) ABSTRACT

A valve train of a combustion piston engine having an actuating device which comprises a phase shift gearbox with two inputs and an output for phase adjustment of a camshaft. The first input is connected with a crankshaft, the second input is connected with a controllable braking device and the output is rotationally fixed with the camshaft. The brake is an electromagnetically controlled friction brake which comprises an electromagnet and magnetic coil. A brake rotor is connected with the second input and can be biased, by the magnetic field of the electromagnet, against a friction surface. A permanent magnet is positioned axially adjacent the brake rotor such that, by its magnetic field, the brake rotor can be pressed against a fixed friction surface for the adjustment of a basic brake torque with the respective basic pressing force.

8 Claims, 2 Drawing Sheets

(56) References Cited

U.S. PATENT DOCUMENTS

| | | | | |
|---|---|---|---|---|
| 2003/0226534 | A1 | 12/2003 | Watanabe et al. | |
| 2009/0260590 | A1 * | 10/2009 | Watanabe et al. | 123/90.17 |
| 2011/0079190 | A1 | 4/2011 | Meintschel et al. | |
| 2011/0253086 | A1 * | 10/2011 | Walliser et al. | 123/90.17 |

FOREIGN PATENT DOCUMENTS

| | | | |
|---|---|---|---|
| DE | 10 2008 031 505 | A1 | 1/2010 |
| DE | 10 2008 043 673 | A1 | 5/2010 |
| DE | 10 2008 060 926 | A1 | 6/2010 |
| DE | 10 2008 060 927 | A1 | 6/2010 |
| DE | 10 2010 021 774 | A1 | 12/2011 |
| WO | 03/095803 | A1 | 11/2003 |
| WO | 2005/047659 | A1 | 5/2005 |
| WO | 2011/147506 | A1 | 12/2011 |

OTHER PUBLICATIONS

International Search Report Corresponding to PCT/EP2011/061473.
Written Opinion Corresponding to PCT/EP2011/061473.
International Preliminary Report on Patentability Corresponding to PCT/EP2011/061473.

* cited by examiner

VALVE TRAIN OF A COMBUSTION PISTON ENGINE

This application is a National Stage completion of PCT/EP2011/061473 filed Jul. 7, 2011, which claims priority from German patent application serial no. 10 2010 039 861.6 filed Aug. 27, 2010.

FIELD OF THE INVENTION

The invention concerns a valve train of a combustion piston engine comprising of an actuator device with a superimposing gear, with two input elements and an output element for phase shifting a camshaft.

BACKGROUND OF THE INVENTION

Due to higher requirements with regard to power, torque, gasoline consumption, and emissions, modern four-cycle combustion piston engines are in almost all cases provided with actuator devices for the phase shifting of the inlet and/or the exhaust camshaft through which the opening times and closing times of the inlet and/or exhaust valves can mainly be modified with regard to rotational speed and load. Through adequate phase adjustment of the inlet and exhaust camshafts, stable idling, increased torque at lower rotational speed of the motor, increased maximum performance and reduced pollutant emission at partial load operation of the respective combustion piston engine can be achieved.

Known actuator devices for the phase adjustment of a camshaft are designed as hydraulic rotary adjusters or as electromechanical rotary adjusters which are positioned immediately between a hub, provided with a chain or toothed belt loop, and the axle of the camshaft wheel which is connected in a rotationally fixed manner with the camshaft. However, disadvantages of such direct rotation adjuster devices are the required actuator forces and the large control effort for the setting of a certain phase angle.

For the improvement of the control characteristics, adjuster devices are therefore proposed for the phase adjustment of a camshaft, in which in the valve train, between the crankshaft and the camshaft, a phase shifter gearbox is provided which is in an operative connection with an adjustment driver. The phase shifter gearbox has generally two input elements and an output element, whereby the first input element, for instance via a chain or toothed belt, is in an operating connection with the crankshaft, the second input element is connected to a controllable adjustment drive, and the output element is connected in a rotationally fixed manner with the cam shaft.

A preferred use of a phase shifter gearbox is a simple planetary transmission or a coupled planetary transmission which comprises components of two planetary gear sets. The actuator drive can be designed as an auxiliary power controlled rotary drive, such as for instance as an electric motor or as a hydraulic rotary adjuster, or as a controllable brake device.

In view of its construction and its control, an especially simple and cost-effective brake device is designed as a friction brake which comprises an enclosure-mounted electromagnet with a magnet body and a magnet coil, as well as a rotationally fixed and axially shiftable brake rotor which is linked with the second input element and which can be pressed against an enclosure-mounted friction surface through the magnetic field of the electromagnet. Since the second input element would be rotating in the running condition faster than the first input element, adjustment of a certain, averaged brake torque is effective at the brake rotor and thus at the second input element, and a certain phase position of the assigned countershaft is maintained. Beginning at this phase position of the camshaft, an adjustment towards early is achieved through a brief increase of the brake torque, and towards late through a brief decrease of the brake torque.

An actuator device for phase adjustment of a camshaft with a phase shifter gearbox and with its operative connection of a brake device is known through DE 10 2006 011 806 A1. The phase shifter gearbox of this actuator device is designed as a coupled planetary transmission with two sun gears with different diameters and teeth count, as well as a planetary carrier which carries several rotatably mounted, two-step planetary gears, wherein the first input element is formed through the planetary carrier, the second input element through the smaller sun gear, and the output element through the larger sun gear.

The brake device is designed as an electromagnetic controllable friction brake which comprises a enclosure-fixed electrode magnet with a magnet body and a magnet coil, as well as a rotationally fixed and axially shiftably, connected with the smaller sun gear, and the brake rotor which can be pressed through the magnetic field of the electro magnet against a friction surface which is positioned at the magnet body. When the electromagnet is turned off, the disc shaped brake rotor is axially pressed by a spring against the planetary carrier, through which at least one locking element engages in a respective recess of the planetary carrier, wherein the planetary transmission is blocked in itself and rotates rigidly. When the electromagnet is turned on, the brake rotor is pulled against the reset force of the spring axially to the outside and against the traction surface of the magnet body, wherein the coupling between the smaller sun gear, and the planet carrier is eliminated and the smaller sun gear is decelerated accordingly based on the effective brake torque.

In accordance with its functional construction, a largely identical actuator device for the phase adjustment of a countershaft is published in the DE 10 2006 028 554 A1. Different from the previously mentioned actuator device, the phase shifter gearbox of this actuator device is designed as a simple planetary transmission with a sun gear, a planetary carrier which carries several, rotatably positioned planetary wheels and a ring gear, whereby the first input element is formed through the planetary carrier, the second input element through the sun gear, and the output element through the ring gear.

However, an additional type of actuator device for phase adjustment of a camshaft in accordance with DE 10 2008 043 673 A1 has an inverse control characteristic. The phase shifter gearbox is, like in the actuator device in accordance with DE 10 2006 028 554 A1, designed as a simple planetary transmission. However, the brake rotor which is rotationally fixed and axially shiftably positioned on a rigid shaft, which is connected with the sun gear, is hereby axially positioned outside of the electromagnet and clamped, by a spring, axially with reference to a freely rotatably positioned pressure disc. The pressure disc is axially positioned within the electrical magnet, adjacent the planetary carrier, and as cams to engage in recesses of the planetary carrier and for control lugs of the ring gear, which locks the planetary carrier with the ring gear in an emergency operating position, when the electromagnet is turned off. In addition, the brake rotor is pressed, when the electromagnet turned off, by a spring against an enclosure-fixed friction surface. When the electromagnet is turned on, the pressure disc is pulled axially away from the planetary carrier against the reset force of the spring and thus locking between the planetary carrier and the ring gear is eliminated.

At the same time, the brake rotor is pulled away axially from the enclosure-fixed friction surface in accordance with the strength of the magnetic field against the reset force of the spring, and thus the effective brake torque is reduced.

Disadvantageously in these known actuator devices for a phase adjustment of the camshaft is the permanent energy consumption of the electromagnet during operation of the combustion piston engine and the respective actuator device. Also, in each case of the actuated devices a relatively strong magnetic field is required, against the reset force of the spring, to achieve a sufficient large brake torque for the adjustment and holding of the respective phase angle of the camshaft.

SUMMARY OF THE INVENTION

Based on this background, the objective of the invention has the task to create a valve train of a combustion piston engine with an actuator device for the phase shift of a camshaft in the above mentioned art, in which a lower amount of energy consumed and the construction of the actuator device is simplified.

This object is achieved in conjunction with the characteristics in which a permanent magnet is positioned axially adjacent the brake rotor, and its magnetic field can press the brake rotor with a respective basic pressing force against an enclosure-fixed friction surface for the adjustment of a basic brake torque.

Thus, the invention starts with a basically known valve train of a combustion piston engine which comprises an actuator device with a phase shifter gearbox with two input elements and an output element for the phase adjustment of a camshaft. The first input element is in an operative connection, for instance through a chain or toothed belt drive, with a crankshaft, the second input element is in an operative connection with a controllable break device, and the output element is connected in a rotationally fixed manner with a camshaft. The brake device is designed as an electromagnetically controllable friction brake which comprises a enclosure-fixed electromagnet with a magnet body and a magnet coil, as well as a rotationally fixed and axially shiftable brake rotor, which is connected with the second input element and which can be pressed through the magnetic field of an electromagnet against an enclosure-fixed friction surface.

Through the positioning of a shifting of a permanent magnet, axially neighboring the brake rotor, a more or less constant magnetic field is now generated, through which the brake rotor, when the electromagnet is switched off, is pressed with a defined basic pressing force against an enclosure-fixed traction surface and is therefore adjusted to a basic brake torque which is effective at the second input element. To adjust a brake torque which deviates from this basic brake torque, only an increase or decrease of the basic pressing force is required with the electromagnet, which requires a significantly lower amount of energy in comparison to known actuator devices.

The permanent magnet is advantageously designed in a way and positioned so that the camshaft, during an engine start and a failure of the power supply for the electromagnet and/or its control, is held in a defined basic position or adjusted to it through the adjusted basic brake torque. It is hereby achieved that the electromagnet needs to be turned on only for the adjustment of the actual phase position of the camshaft and that a special safety device (Fail Safe) is not needed, such as in the known actuator devices where form-fit locking is provided between the brake rotor and the second input element of the phase shifter gearbox or between the first input element and the output element of the phase shifter gearbox.

In principle, the permanent magnet could be positioned radially within or outside of the electromagnet, or at the side facing away from the electromagnet, adjacent the brake rotor. However, it would become disadvantageous due to an increased construction effort and larger dimensions of the brake device. Thus, it is here provided that the permanent magnet is positioned within the magnetic flow of the electromagnet, so that the magnet body of the electromagnet and the adjacent section of the brake rotor can be used for creating a close magnetic flow circle of the permanent magnet. In addition, the overlay of the magnetic fields of both magnets is improved, and therefore also the control of the resulting brake torque.

Such positioning of the permanent magnets can appropriately be realized in a way so that the permanent magnet is designed in a ring shape and has an axial orientation of its poles (N, S), as well as being positioned in a respective radially inner or outer recess of the magnetic body of the electromagnet.

As an alternative hereto, it is also possible that the permanent magnet is designed in a ring shape and has a radial orientation of its poles (N, S), as well as being positioned in a respective axial outer, meaning at the side facing away from the brake rotor, recess of the magnetic body of the electromagnet.

The adjustment of the phase angle of the camshaft is now simply achieved in such a way that the magnetic field of a permanent magnet, for an increase of the effective brake torque at the brake rotor, meaning for the adjustment of the camshaft in the direction early, is increased by means of a suitable control device creating the same polarity of the electromagnet, and for a decrease of the brake torque which is effective at the brake rotor, meaning for the adjustment of the countershaft in the direction late, is reduced through a reversed polarity of the electromagnet.

To safely prevent possible assembly errors of the actuator device and excessive wear at the enclosure-fixed brake surface and at the brake rotor, effective end stops can be provided between the first input element and the output element of the phase shifter gearbox, to limit the adjustment range of the phase adjustment of the camshaft to a permitted phase angle range.

BRIEF DESCRIPTION OF THE DRAWINGS

Drawings of the embodiment examples are included with the description for the clarification of the invention. These show.

DETAILED DESCRIPTION OF THE PREFERRED EMBODIMENTS

Figure 1:
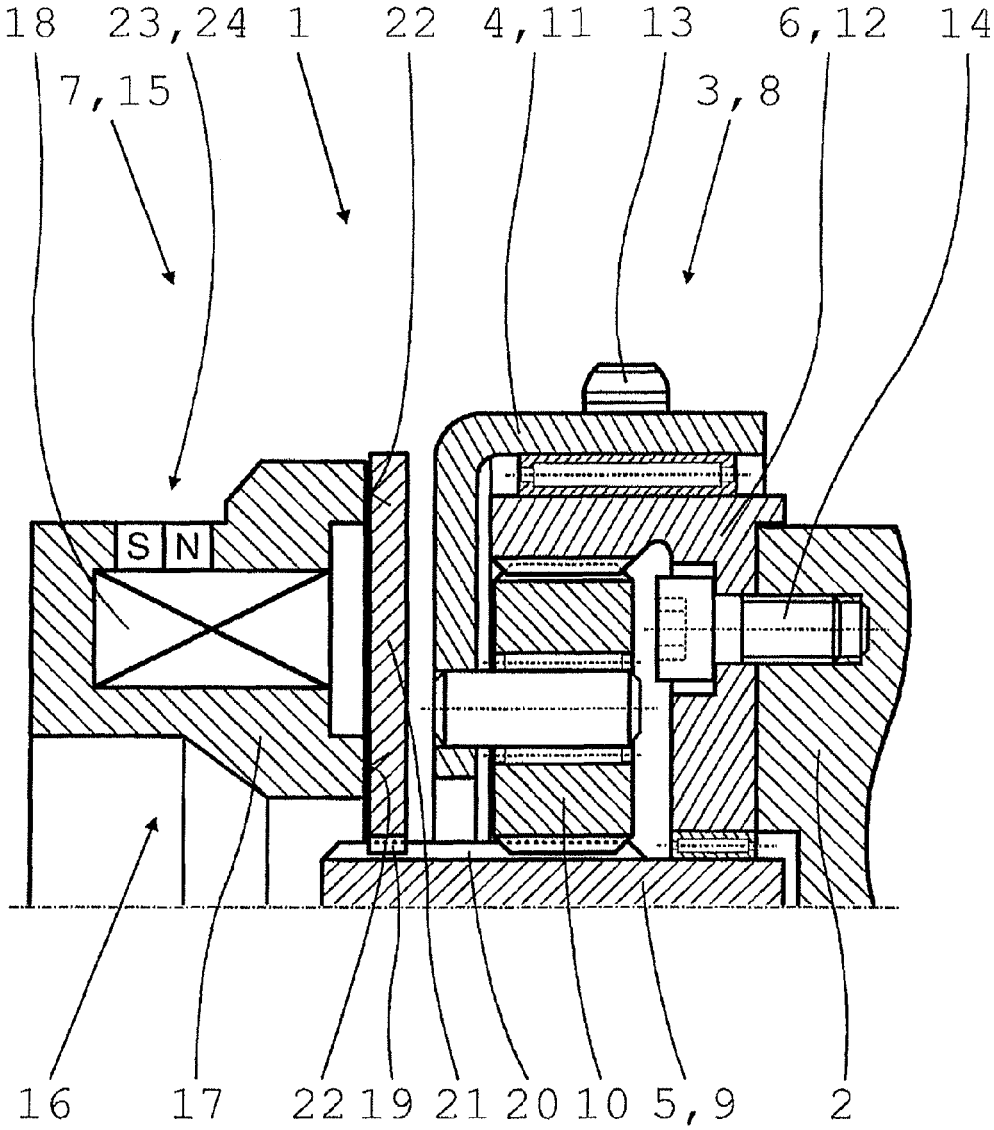
FIG. 1 A section of a valve train with an inventive actuator device for the phase adjustment of a camshaft in a longitudinal center cut section, and FIG. 2 a second variation of the inventive actuator device for the phase adjustment of a camshaft in accordance with FIG. 1.

A valve train, which is presented in FIG. 1 in a sectional view of a combustion piston engine, is provided with an actuator device 1 for the phase adjustment of a camshaft 2 which comprises a phase shifter gearbox 3 with two input elements 4, 5 and an output element 6, as well as a controllable braking device 7. As presented, the phase shifter gearbox 3 is designed in this example as a simple planetary transmission 8 with a sun gear 9, several rotatably positioned planetary gears 10 carried by the planetary carrier 11 and a ring gear 12. The planetary carrier 11 forms the first input element 4 and is provided with a chain sprocket 13 through which, by means of a not shown control chain, a form-fit drive connection exists with the crankshaft of the combustion piston engine. The sun gear 9 forms the second input element 5, which is in an operative connection with the brake device 7. The ring gear 12 forms the output element 6 and is rigidly connected by several screws 14 with the camshaft 2.

The brake device 7 is designed as an electromagnetically controllable friction brake 15 and comprises an enclosure-mounted electromagnet 16 with a U-shaped cross-section and is designed as a magnet body 17 made of ferromagnetic material and a magnet coil 18, a brake rotor 21 is positioned rotationally fixed and axially shiftable on the axially extending outer teething 20 of the sun gear 9. The brake rotor 21 is designed at least in the area adjacent to the magnet body 17 with a ferromagnetic material so that it is pressed, when the electromagnet 16 is turned on, axially against the friction surfaces 22 of the magnet body 17 due to the induced magnetic field and thereby, braking torque is created which is effective on the sun gear 9.

In accordance with the invention, a permanent magnet 23 is provided which is designed in a ring shape, which has an axial orientation of the poles N, S, and which is positioned in a respective, radial outer recess 24 of the magnet body 17 of the electromagnet 16. Hereby, the permanent magnet 23 is positioned within the magnetic flux of the electromagnet 16 such that, on one hand, the overlay of the magnetic fields of both magnets 16, 23 is improved and, on the other hand, the common use of the magnetic body 17 allows an amplification of the magnetic field and its friction surfaces 22 for the braking of the brake rotor 21 through both magnets 16, 23.

The advantageous functionality of the inventive actuator device 1 is that, through the permanent magnet 23 and therefore without an energy effort, a constant magnetic field is create through which the brake rotor 21 is pressed against the friction surfaces 22 of the magnetic body 17, thus an effective basic brake torque is created at the sun gear 9 of the phase shifter gearbox 3.

The permanent magnet 23 is preferably dimensioned such that the camshaft 2, when starting the engine and during a failure of the power supply of the electromagnet 16 and/or its control, is automatically kept in a defined basic position or adjusted to this position through the adjusted basic brake torque. Thus, the form-fit lock provided in the known actuator devices between the brake rotor 21 and the planetary carrier 11, or between the planetary carrier 11 and the ring gear 12, respectively, can be omitted which results in a construction space gain and cost reduction.

For the adjustment of the phase position of the camshaft 2, the magnetic field of the permanent magnet 23 is amplified, for an increase of the brake torque which is effective at the brake rotor 21, meaning for the adjustment of the camshaft in the direction early, through a same polarity of the electromagnet 16, and the brake torque which is effective at the brake rotor 21, meaning for an adjustment of the camshaft 2 in the direction late, is decreased through an opposite polarity of the electromagnet 16. Through the adjustment of the brake torque which is effective at the brake rotor 21, relative to the basic brake torque which is created through the permanent magnet 23, the energy consumption of the electromagnet 16 in comparison to the known actuator devices is significantly lower and control of the brake torque is improved with the increased dynamics.

Figure 2:
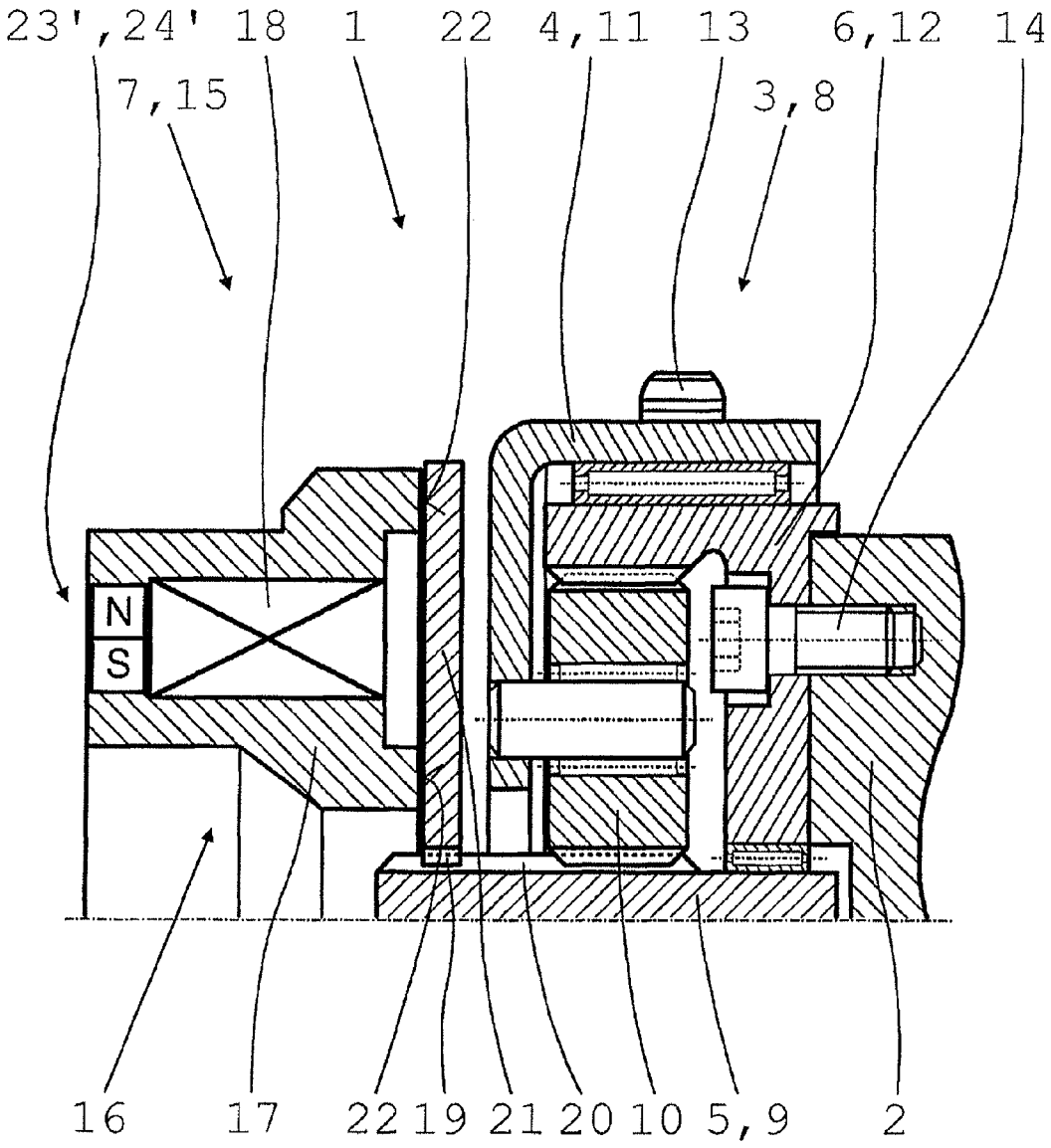

A second variation of the invented actuator device for the phase adjustment of a camshaft 2, which is shown in FIG. 2, only differs from the variation shown in FIG. 1 that the ring shape designed permanent magnet 23' has now a radial orientation of its poles (N, S) and is positioned, on the side facing away from the brake rotor 21, in an axial, outer recess 24' of the magnetic body 17 of the electromagnet 16.

REFERENCE CHARACTERS

1 Actuator Device
2 Camshaft
3 Phase Shift Gearbox
4 First Input Element
5 Second Input Element
6 Output Element
7 Brake Device
8 Planetary Transmission
9 Sun Gear
10 Planetary Wheel
11 Planetary Carrier
12 Ring Gear
13 Chain Sprocket
14 Screw
15 Friction Brake
16 Electromagnet
17 Magnet Body
18 Magnet Coil
19 Inner Teething
20 Outer Teething
21 Brake Rotor
22 Friction Surface
23, 23' Permanent Magnet
24, 24' Recess
N Pole of the Permanent Magnet
S Pole of the Permanent Magnet

The invention claimed is:

1. A valve train of a combustion piston engine, having an actuating device (1), comprising:

a phase shift gearset (3) with first and second input elements (4, 5) and an output element (6) for a phase adjustment of a camshaft (2), the first input element (4) being drivingly connected with a crankshaft, the second input element (5) being operatively connected with a controllable braking device (7), and the output element (6) being connected, in a rotationally fixed manner, with the camshaft (2), the braking device (7) being an electromagnetically controllable friction brake (15) comprising an enclosure-mounted electromagnet (16), a magnetic coil (18), and brake rotor (21) that is rotationally fixed and axially shiftably connected with the second input element (5), and which is pressed by a magnetic field of the electromagnet (16) against an enclosure-mounted friction surface (22), and a permanent magnet (23, 23') being positioned axially adjacent the brake rotor (21) such that a magnetic field permanent magnet (23, 23') biasing the brake rotor (21) for adjustment of a basic brake torque, with a respective basic pressing force, against the enclosure-mounted friction surface (22).

2. The valve train according to claim 1, wherein the permanent magnet (23, 23') is designed and positioned such that the camshaft (2), when starting the engine and in case of a failure of at least one of a voltage source for the electromagnet (16) and control of the electromagnet (16), is either maintained in a defined basic position or automatically adjusted to the defined basic position through a defined basic brake torque.

3. The valve train according to claim 1, wherein the permanent magnet (23, 23') is positioned within the magnetic flux of the electromagnet (16).

4. The valve train according to claim 3, wherein the permanent magnet (23) is ring shaped, poles (N, S) of the permanent magnet are axially orientated, and the permanent magnet is positioned in one of a radially inner recess and a radially outer recess (24) of the magnetic body (17) of the electromagnet (16).

5. The valve train according to claim 3, wherein the permanent magnet (23') is ring shaped, poles (N, S) of the permanent magnet are radially oriented, and the permanent magnet is positioned in an axial, outer recess (24') of the magnet body (17) of the electromagnet (16).

6. The valve train according to claim 1, wherein the magnetic field of the permanent magnet (23, 23') is amplified, by a control device with a same polarity of the electromagnet (16), for increasing an effective brake torque of the brake rotor (21), and the magnetic field of the permanent magnet is reduced, with an opposite polarity of the electromagnet (16), for a reducing the effective brake torque of the brake rotor (21).

7. The valve train according to claim 1, wherein effective end stops are provided, between the first input element (4) and the output element (6) of the phase shift gearset (3), to limit an adjustment range of the phase adjustment of the camshaft (2) so as to a permitted phase angle range.

8. A valve train of a combustion piston engine with an actuated device (1) comprising:

a phase shift gearset (3), first and second input elements (4, 5) and an output element (6) for adjusting a phase of a camshaft (2), the first input element (4) being drivably connected with a crankshaft of the combustion piston engine, the second input element (5) being operatively connected to a controllable brake device (7), and the output element (6) being rotationally fixed to the camshaft (2), the brake device (7) being an electromagnetically controllable friction brake (15) and comprising an enclosure-mounted electromagnet (16), a magnetic coil (18) and a brake rotor, the brake rotor being supported by the second input element such that the brake rotor being rotationally fixed and axially slidable with respect to the second input element, the brake rotor being axially biased by a magnetic field of the electromagnet (16) so as to frictionally engage an enclosure-mounted friction surface (22), a permanent magnet (23, 23') being supported by the electromagnet axially adjacent the brake rotor (21) such that a magnetic field of the permanent magnet axially biases the brake rotor (21) to frictionally engage the enclosure-mounted friction surface (22) and adjust a basic brake torque with a respective basic pressing force.

* * * * *